US005200757A

United States Patent [19]

Jairam

[11] Patent Number: 5,200,757

[45] Date of Patent: Apr. 6, 1993

[54] MICROWAVE ANTENNAS HAVING BOTH WIDE ELEVATION BEAMWIDTH AND A WIDE AZIMUTH BEAMWIDTH OVER A WIDE FREQUENCY BANDWIDTH

[75] Inventor: Hari L. Jairam, Harrow, England

[73] Assignee: GEC-Marconi Limited, England

[21] Appl. No.: 703,886

[22] Filed: May 22, 1991

[30] Foreign Application Priority Data

May 23, 1990 [GB] United Kingdom ..... 9011576

[51] Int. Cl.[5] ..... H01Q 13/00

[52] U.S. Cl. ..... 343/786; 343/772

[58] Field of Search ..... 343/786, 776, 770, 771, 343/772, 785; 333/239, 34, 35

[56] References Cited

U.S. PATENT DOCUMENTS

| | | | |
|---|---|---|---|
| 2,283,935 | 5/1942 | King | 250/11 |
| 2,742,640 | 4/1956 | Cronin | 343/772 |
| 4,129,871 | 12/1978 | Johns | 343/727 |
| 4,590,479 | 5/1986 | Ben-Dov | 343/771 |
| 4,636,798 | 1/1987 | Seavey | 343/753 |
| 4,763,130 | 8/1988 | Weinstein | 343/770 |
| 4,952,892 | 8/1990 | Kronberg | 333/34 |

FOREIGN PATENT DOCUMENTS

| | | | |
|---|---|---|---|
| 1129221 | 1/1957 | France | 343/772 |
| 528203 | 6/1955 | Italy | 343/772 |
| 747304 | 4/1956 | United Kingdom . | |
| 2089579 | 6/1982 | United Kingdom . | |

*Primary Examiner*—Rolf Hille
*Assistant Examiner*—Huanganh Le
*Attorney, Agent, or Firm*—Kirschstein, Ottinger, Israel & Schiffmiller

[57] ABSTRACT

A microwave horn antenna comprising a hollow cylindrical horn (11) having a rear section of tapered internal dimension extending towards a tubular radiation open end. The open end incorporates a number of parallel-sided slots (17), which extend at angles of 45 degrees to the horn axis. The slots (17) terminate at the open end in semi-circular cut-out portions (17B). A dielectric lens (19) is fitted over the open end of the horn. The antenna provides a wide beamwidth of approximately 90 degrees over a frequency ban of 8 to 18 GHz.

16 Claims, 3 Drawing Sheets 13
11
17B
17
17A
17
15
17
17
17
17
17

23
21
27
27
25
27
27

MICROWAVE ANTENNAS HAVING BOTH WIDE ELEVATION BEAMWIDTH AND A WIDE AZIMUTH BEAMWIDTH OVER A WIDE FREQUENCY BANDWIDTH

BACKGROUND OF THE INVENTION

This invention relates to microwave antennas.

More particularly the invention relates to microwave antennas having both a wide elevation beamwidth and a wide azimuth beamwidth over a wide frequency bandwidth. Such antennas find application, for example, in airborne ground surveillance radar systems where the antenna is mounted on the nose of the aircraft and directed ahead of the aircraft.

SUMMARY OF THE INVENTION

It is an object of the present invention to provide a novel form of microwave antenna capable of meeting these requirements.

According to the present invention a microwave antenna comprises a horn radiator having a tubular radiating end portion, there being at least four open-ended cut-outs in said end portion.

Preferably said cut-outs are substantially identical, substantially uniformly distributed around said end portion, and are of even number.

In one particular embodiment said cut-outs comprise parallel-side slots. Preferably the slots open into semi-circular portions of the cut-outs at their open ends. In one such arrangement the slots extend parallel to the axis of the tubular end portion and there is provided between each pair of adjacent slots a capacitive stud which extends radially inwards of the tubular end portion. In another such embodiment the slots extend at an acute angle to the axis of the tubular end portion, typically at 45°. There may be a dielectric lens which fits over the end portion.

Where the cut-outs are in the form of parallel-sided slots there are suitably ten cut-outs.

In another embodiment of the invention said cut-outs are V-shaped with their wider ends in the plane of the radiating end of the horn. Preferably the cut-outs have included angles of substantially 90° and adjacent cut-outs meet one another at their wider ends.

The horn radiator preferably houses a dielectric impedance-matching insert.

BRIEF DESCRIPTION OF THE DRAWINGS

Several microwave antennas in accordance with the invention will now be described, by way of example, with reference to the accompanying drawings, in which.

DETAILED DESCRIPTION OF THE PREFERRED EMBODIMENTS

Figure 1:
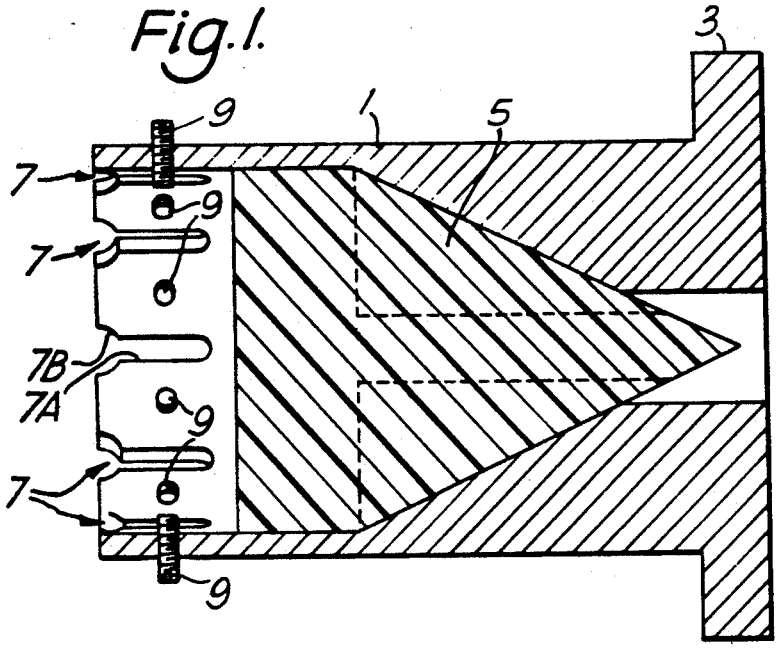
FIG. 1 is a sectional view of a first antenna.
Figure 2:
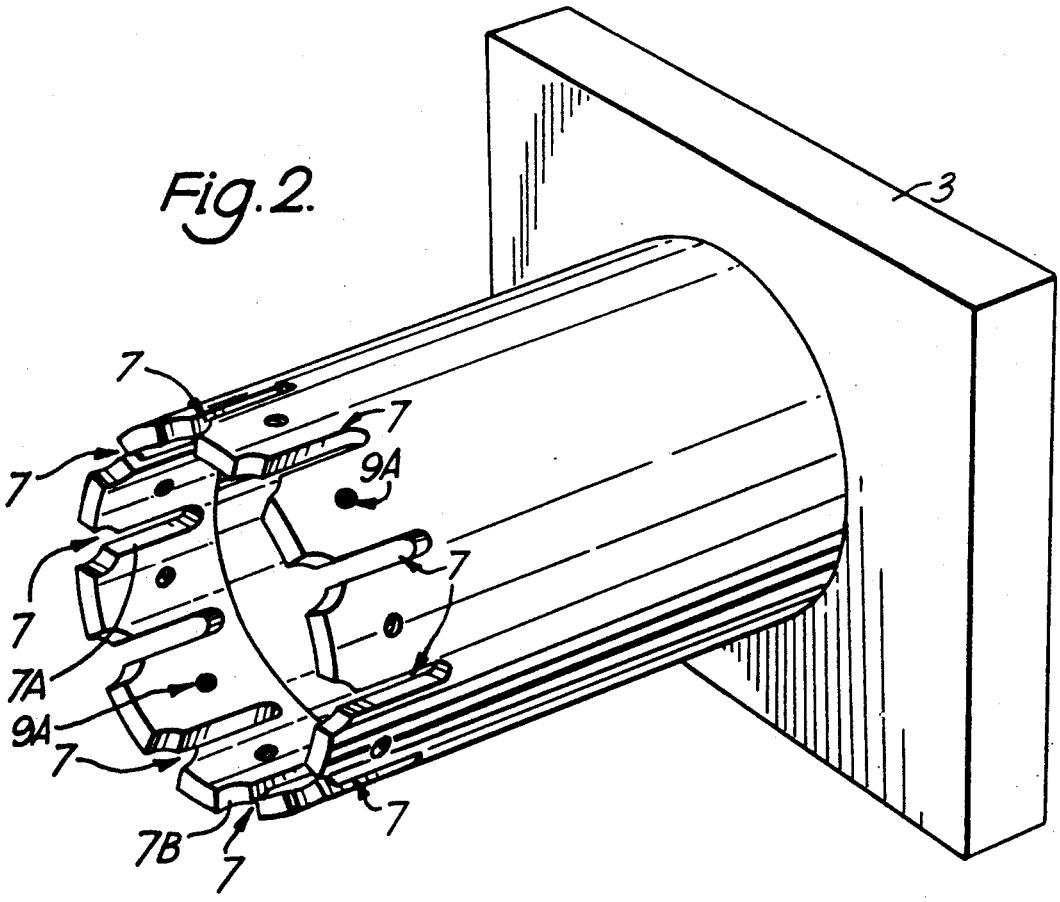
FIG. 2 is a perspective view of the antenna of FIG. 1.

Referring to FIGS. 1 and 2, the first antenna to be described comprises a horn radiator defined by a hollow electrically-conductive member 1 of circular cross-section, suitable of aluminum. A mounting flange 3 at one end of the horn member 1 enables the antenna to be secured to a polarizer (not shown). The horn member 1 has a plain cylindrical outer surface, but internally it has a conical, i.e. tapered, transition from a large bore outer portion, which provides a tubular radiating end portion, to a small bore inner portion. The tapered portion of member 1 constitutes the 'horn'.

The horn member 1 houses an impedance-matching insert 5 of dielectric material, suitably PTFE. This insert 5 has a 'solid' cylindrical part which is a close fit within the tubular end portion of the member 1 and extends from the tapered portion (approximately) half way to the open end of the radiator. This cylindrical part of the insert 5 may be integral with a 'conical' section which fits snugly within the tapered portion. The 'conical' section is 'relieved' so as to provide cruciform cross-section.

In an alternative construction, the member 1 is tubular, e.g. it has a uniform internal diameter, and the tapered portion is provided by the insertion into the member 1 of a plurality of electrically-conductive wedges (not shown). Preferably there are four such wedges symmetrically, i.e. equi-angularly, distributed within the member 1 towards the end adjacent the mounting flange 3.

Extending into the horn member 1 from its open end there are ten cut-outs 7, each in the form of a parallel-sided slot 7A extending parallel to the axis of the member 1. Each slot 7A opens into a semi-circular cut-out portion 7B at its open end.

The cut-outs 7 are all of the same shape and size and are uniformly distributed around the circumference of the horn member 1. The cut-outs 7 have a length not less than a quarter of the free space wavelength of signals at the upper end of the frequency band width over which the antenna is required to operate.

Between each pair of adjacent slots 7A there is a capacitive stud 9 in the form of a projection extending radially inwards form the tubular end portion of the member 1. The studs 9 may be of fixed length but preferably are of screw form for ease of adjustment. In FIG. 2 tapped holes 9A only for the studs 9 are shown for clarity.

The cut-outs 7 serve to allow sideways scatter of energy and thereby increase the effective beamwidth of the antenna in respect of those components of circularly polarized waves in the member 1 whose E-fields are directed across the width of the slot portions 7A of the cut-outs 7.

The capacitive studs 9 serve to increase the effective beamwidth of the antenna in respect of those components whose E-fields are in the direction of the lengths of the slot portions 7A of the cut-outs 7.

The semi-circular portions 7B of the cut-outs 7 serve to reduce edge effects and the inner ends of the slot portions 7A of the cut-outs are radiused for the same purpose. The semi-circular portions 7B also serve to increase beamwidth, more especially at the upper end of the operating frequency band.

In one particular embodiment of the antenna of FIGS. 1 and 2 for use with signals in the frequency band 8 to 18 GHz the end portion of the horn member 1 in which the cut-outs 7 are formed has an external diameter of 23.8 mm and an internal diameter of 19.9 mm, the cut-outs 7 have an axial length of 8 mm, the slot portions 7A have a width of 2 mm and the semi-circular portions a radius of 2.5 mm. The tapered portion of the horn member 1 starts at a distance of 15 mm from the open end of the member 1 and the tapered section is itself 15 mm long.

With these dimensions the antenna has an azimuth and elevation 3 dB beam width of 80±7.5 degrees over the whole 8–18 GHz bandwidth.

Figure 3:
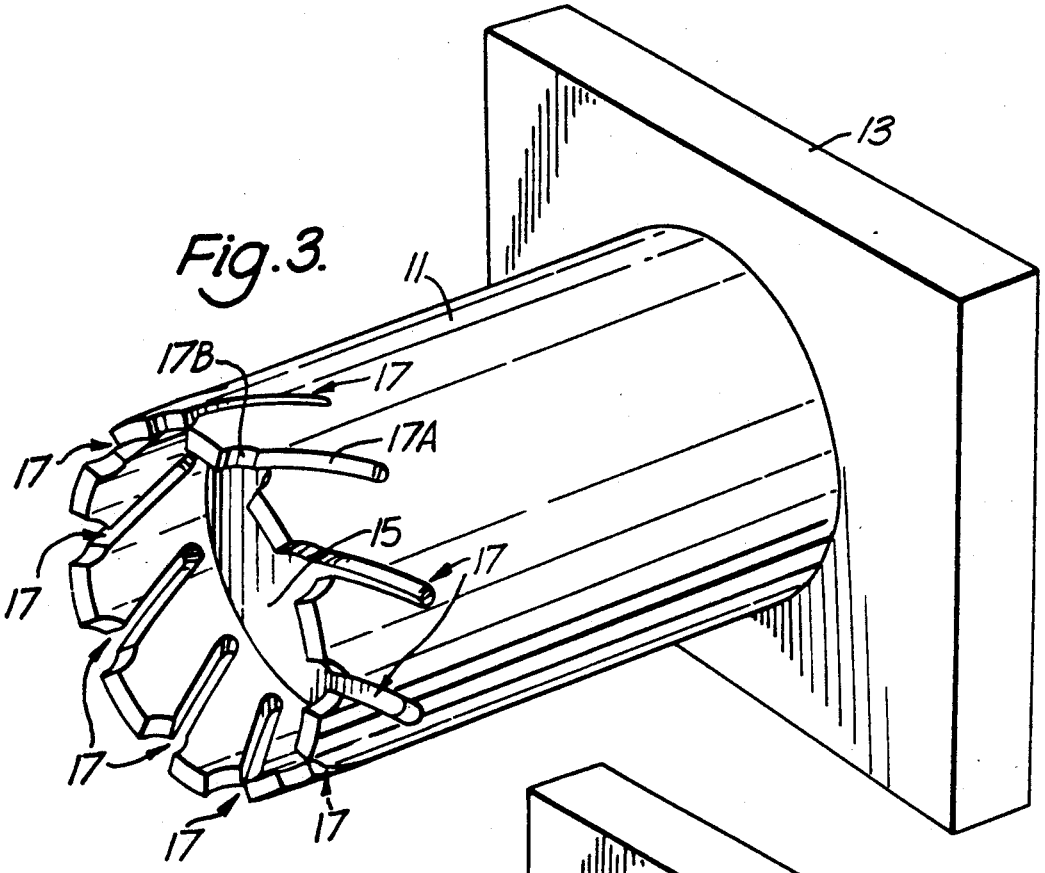
FIG. 3 is a perspective view of a second antenna.

Referring to FIG. 3, the second antenna to be described by way of example comprises a horn member 11, flange 13 and impedance insert 15 housed in the member 11, which correspond to the members 1, 3 and 5 respectively of the antenna of FIGS. 1 and 2, but has ten cut-outs 17 of different form. In this antenna the cut-outs 17, whilst including semi-circular portions 17B identical to those of the antenna of FIGS. 1 and 2, have parallel-sided slot-portions 17A which extend at an acute angle of 45° to the axis of the horn member 11. In addition, no capacitive studs corresponding to the studs 9 of the antenna of FIGS. 1 and 2 are provided in the antenna of FIG. 3, the acute angling of the slot-portions 17A rendering them unnecessary.

For nominally the same performance as the antenna of FIGS. 1 and 2, the axial length of the cut-outs 17 of the antenna of FIG. 3 will be the same as the axial length of the cut-outs 7 of the antenna of FIGS. 1 and 2.

Figure 4:
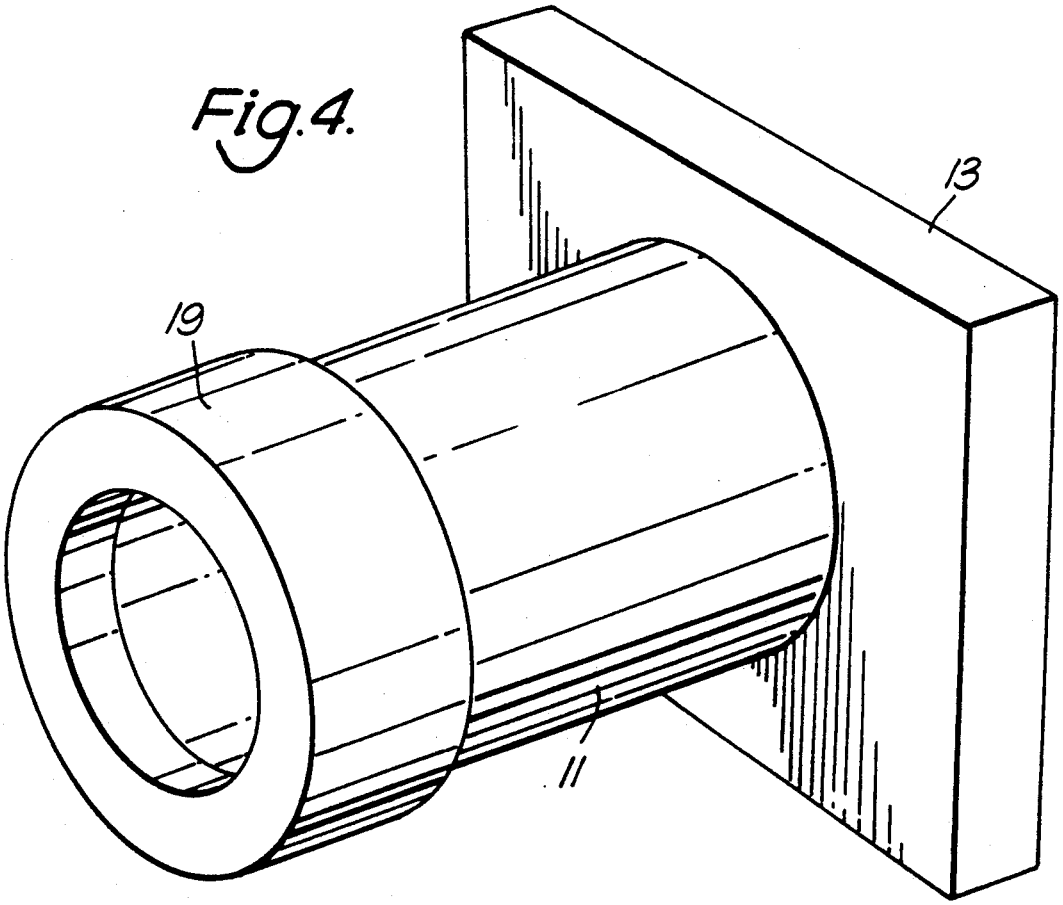
FIG. 4 shows the antenna of FIG. 3 fitted with a dielectric lens.

To further increase beamwidth the antenna of FIG. 3 may be provided with a dielectric lens in the form of a bung 19, made for example of PTFE, fitting over the open end of the member 1, as illustrated in FIG. 4. For an antenna of dimensions as given above, the bung 19 suitably has a radial dimension of 3 mm over an axial length of 8 mm, where it fits around the horn member 11, and reduces in internal diameter to 18 mm over an axial length of 5 mm, where it projects beyond the tubular end portion of the horn member 11. The outer end of the bung 19 is suitably of semi-circular form.

With the lens 19 fitted an azimuth and elevation 3 dB beam width of 90+/−degrees is obtained over a 3:1 frequency bandwidth.

Figure 5:
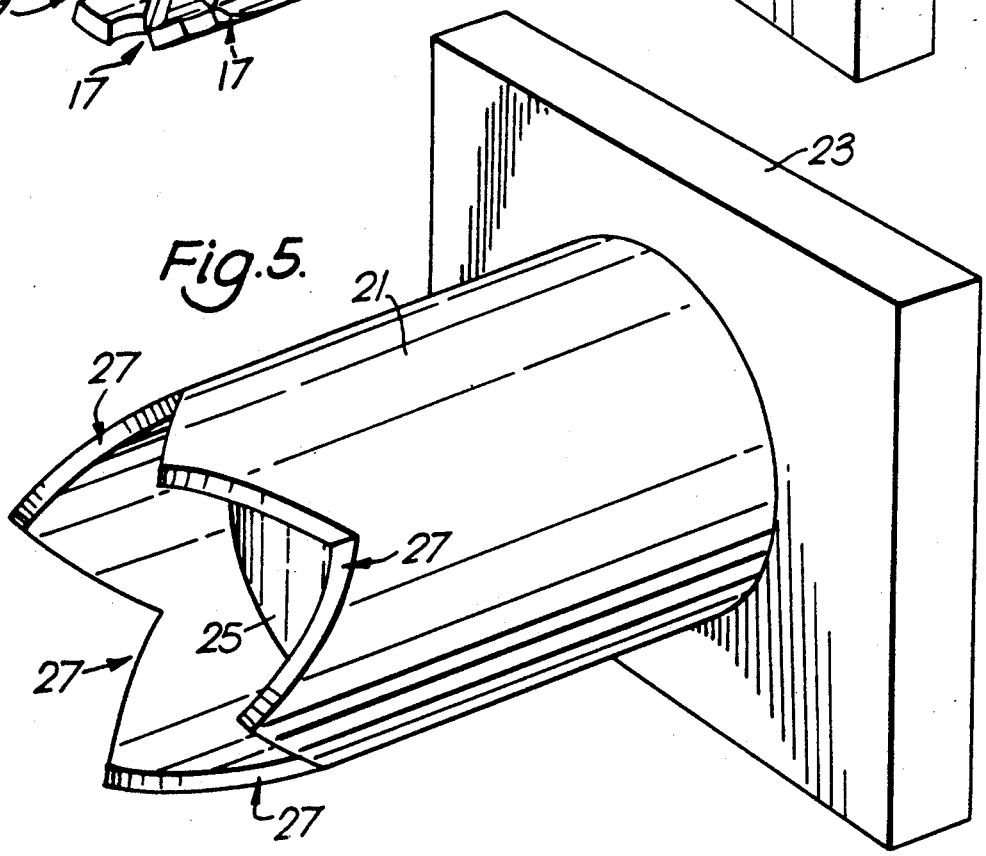
FIG. 5 is a perspective view of a third antenna.

Referring to FIG. 5, the third antenna to be described by way of example again has a horn member 21, flange 23 and impedance insert 25, but in this case only four cut-outs 27 which are V-shaped are provided. The cut-outs 27 have their wider ends in the plane of the open end of the member 21 and at their wider ends subtend an angle of 90° at the axis of the member 21 so as to meet one another at their wider ends. No capacitive studs are provided. The V-shaped cut-outs 27 are suitably of right-angled form, i.e. have included angles of substantially 90°.

Whilst the antenna of FIG. 5 will not provide such good performance as the antennas of FIGS. 1 to 4, it nevertheless exhibits a significant improvement over an antenna wherein the member corresponding to horn member 21 of FIG. 5 i plane-ended, i.e. without any cut-outs.

It will be appreciated that whilst in the embodiment of the invention that have been described the cut-outs are identical, uniformly distributed, and of even number, none of these features is essential in an antenna according to the invention, for instance where unequal azimuth and elevation beamwidths are required.

I claim:

1. A microwave antenna having a beamwidth and a bandwidth over a range of operating frequencies, comprising: a horn radiator including a tubular radiating end portion having a longitudinal axis, and means for maximizing the beamwidth, including at least four open-ended cut-outs formed in said tubular radiating end portion, said cut-outs extending along the axis no more than about one-half wavelength at the highest operating frequency in said range.

2. An antenna according to claim 1, wherein said cut-outs are substantially identical.

3. An antenna according to claim 1, wherein said cut-outs are substantially uniformly distributed around said tubular end portion.

4. An antenna according to claim 1, comprising an even number of said cut-outs.

5. An antenna according to claim 1, wherein said cut-outs comprise parallel-sided slots.

6. An antenna according to claim 5, wherein said tubular end portion has an end face, said parallel-sided slots terminating in cut-out semi-circular portions at said end face.

7. An antenna according to claim 5, wherein said slots extend parallel to said axis, said antenna further comprising a respective capacitive stud between each pair of adjacent slots of said parallel-sided slots, each said stud projecting radially inwards of said tubular end portion.

8. An antenna according to claim 5, wherein said slots extend at an acute angle to said axis.

9. An antenna according to claim 8, wherein said acute angle is substantially 45°.

10. An antenna according to claim 8, further comprising a dielectric lens which fits over said tubular end portion.

11. An antenna according to claim 5, comprising ten said cut-outs.

12. An antenna according to claim 1, wherein said tubular end portion has an end face and said cut-outs are V-shaped, each V-shaped cut-out having an open end at said end face.

13. An antenna according to claim 12, wherein said V-shaped cut-outs have included angles of substantially 90°.

14. An antenna according to claim 12, wherein adjacent cut-outs of said V-shaped cut-outs meet one another at said end face.

15. An antenna according to claim 1, further comprising a dielectric impedance-matching insert housed in said horn radiator.

16. An antenna according to claim 15, wherein said tubular radiating end portion has an adjacent radiation field determined solely by said end portion and the dielectric insert.

* * * * *